US007268655B2

(12) United States Patent
Skinner et al.

(10) Patent No.: US 7,268,655 B2
(45) Date of Patent: Sep. 11, 2007

(54) IGNITION COIL WITH SECONDARY WINDING CENTER TAP CONNECTED TO SHIELD

(75) Inventors: Albert Anthony Skinner, El Paso, TX (US); Kenneth P. Senseman, Noblesville, IN (US); Mark Albert Paul, El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/976,045

(22) Filed: Oct. 28, 2004

(65) Prior Publication Data

US 2006/0091987 A1 May 4, 2006

(51) Int. Cl.
*H01F 27/02* (2006.01)

(52) U.S. Cl. ..... 336/90; 336/92

(58) Field of Classification Search ..... 336/92, 336/90, 96; 123/634–635
See application file for complete search history.

(56) References Cited

U.S. PATENT DOCUMENTS 6,463,918 B1 * 10/2002 Moga et al. ..... 123/633
6,556,118 B1 4/2003 Skinner ..... 336/182
6,799,451 B2 * 10/2004 Kiess et al. ..... 73/35.07
6,860,256 B2 * 3/2005 Nakamura et al. ..... 123/621

FOREIGN PATENT DOCUMENTS

JP 08186039 A * 7/1996

* cited by examiner

*Primary Examiner*—Anh Mai
(74) *Attorney, Agent, or Firm*—Paul L. Marshall

(57) ABSTRACT

A distributorless ignition coil has two high voltage secondary windings wound around a primary winding, with each secondary winding being electrically connected to a respective spark plug. A shield surrounds the secondary windings. The secondary windings share a common center tap between them, and the center tap is electrically connected to the shield, which thus acts as a conductor to convey current back to an end of the shield that conveniently may be connected to ignition components to complete the electrical path, thus obviating the need for an interior wire extending from the center tap inside the coil to the end of the coil case.

20 Claims, 3 Drawing Sheets

IGNITION COIL WITH SECONDARY WINDING CENTER TAP CONNECTED TO SHIELD

FIELD OF THE INVENTION

The present invention relates to vehicle ignition coils.

BACKGROUND OF THE INVENTION

Ignition coils are components that use the coupling between a primary winding and a secondary winding to transform relatively low voltages from the battery into high voltages that are supplied to the spark plugs in vehicle gasoline engines. The spark plugs start the internal combustion process that drives the rods and hence, crankshaft and axles. In older systems, a single ignition coil is provided, and a distributor sends the pulses from the coil through respective high voltage spark plug wires to the spark plugs in the cylinders in accordance with a timing that is established by the distributor.

In relatively modern engines, an engine can have several ignition coils, one for each cylinder or for each pair of cylinders, thereby advantageously eliminating the need for distributors and high voltage wires and also providing more precise control of the engine timing. One example of such an ignition coil system is set forth in U.S. Pat. No. 6,556,118, owned by the present assignee and incorporated herein by reference.

When such a coil is used to energize two spark plugs (either for two different cylinders or for a single cylinder in an engine that has two spark plugs per cylinder), two secondary windings surround the low voltage-carrying primary winding that is wound on an interior ferromagnetic core, with the secondary windings being radially spaced from the primary winding. Each secondary winding, owing to the inductive coupling between it and the primary winding and the different numbers of winding turns between the primary and secondary windings, produces a high voltage that is sent to a respective spark plug.

As understood herein, the ends of the secondary windings that are opposite the ends which are connected to the spark plugs must be connected to ground (in a three conductor system) or to the positive pole of the battery in a two conductor system to complete the electrical path. The present invention also understands that if these ends are located axially between oppositely-wound secondary windings, somehow electrical connection must be made from the middle of the ignition coil to the end, for connection to ground or battery positive. As critically recognized by the present invention, owing the relatively small size of modern ignition coils, the space available to run a lead from between the secondary windings and past one of the high voltage secondary windings to an end connector is limited, making electrical connection using a lead internal to the ignition coil difficult and problematic. Having made these critical observations, the invention below is provided.

SUMMARY OF THE INVENTION

A distributorless ignition coil includes a primary winding that can be connected to a source of voltage such as a vehicle battery. First and second secondary windings are in axial sequence to each other and surround the primary winding. Each secondary winding can be electrically connected to a respective spark plug. Also, each secondary winding is inductively coupled to the primary winding when the primary winding is energized, and the secondary windings are configured to transform relatively lower voltage from the primary winding to relatively higher voltage for supply to the spark plugs. A shield surrounds the secondary windings. In accordance with the present invention, the shield is electrically connected to a center tap terminal between the secondary windings, with the center tap terminal being electrically connected to each secondary winding. With this structure, the shield can electrically connect the center tap terminal to ground or to battery voltage as desired.

In non-limiting implementations the shield defines an end, and the shield is connectable to ground or battery voltage at or substantially near the end. A case can hold the shield and windings and can define a closable open end, and the end of the shield can be juxtaposed with the closable open end of the case.

In illustrative embodiments the shield may be formed with two tabs defining a space between them for receiving the center tap terminal. The tabs can be crimped to hold the center tap terminal therebetween. Or, the shield may be formed with one and only one tab, with the center tap terminal being welded to the tab. In either case, the secondary windings may be wound oppositely to each other relative to an axial dimension of the coil.

In another aspect, an ignition coil includes a primary winding receiving voltage from a source of voltage in a vehicle, and first and secondary windings inductively coupled to the primary winding. A shield surrounds the secondary windings and is radially spaced therefrom. The shield defines a substantial portion of a cylinder and establishes a portion of an electrical circuit including the first secondary winding and a first spark plug. The shield also establishes a portion of an electrical circuit including the second secondary winding and a second spark plug.

In still another aspect, a distributorless ignition system for a vehicle engine includes plural ignition coils. Each ignition coil has first and second secondary windings electrically connected to respective spark plugs. Also, each ignition coil includes a shield surrounding the secondary windings and completing an electrical circuit for each secondary winding.

The details of the present invention, both as to its structure and operation, can best be understood in reference to the accompanying drawings, in which like reference numerals refer to like parts, and in which:

DESCRIPTION OF THE PREFERRED EMBODIMENT

Figure 1:
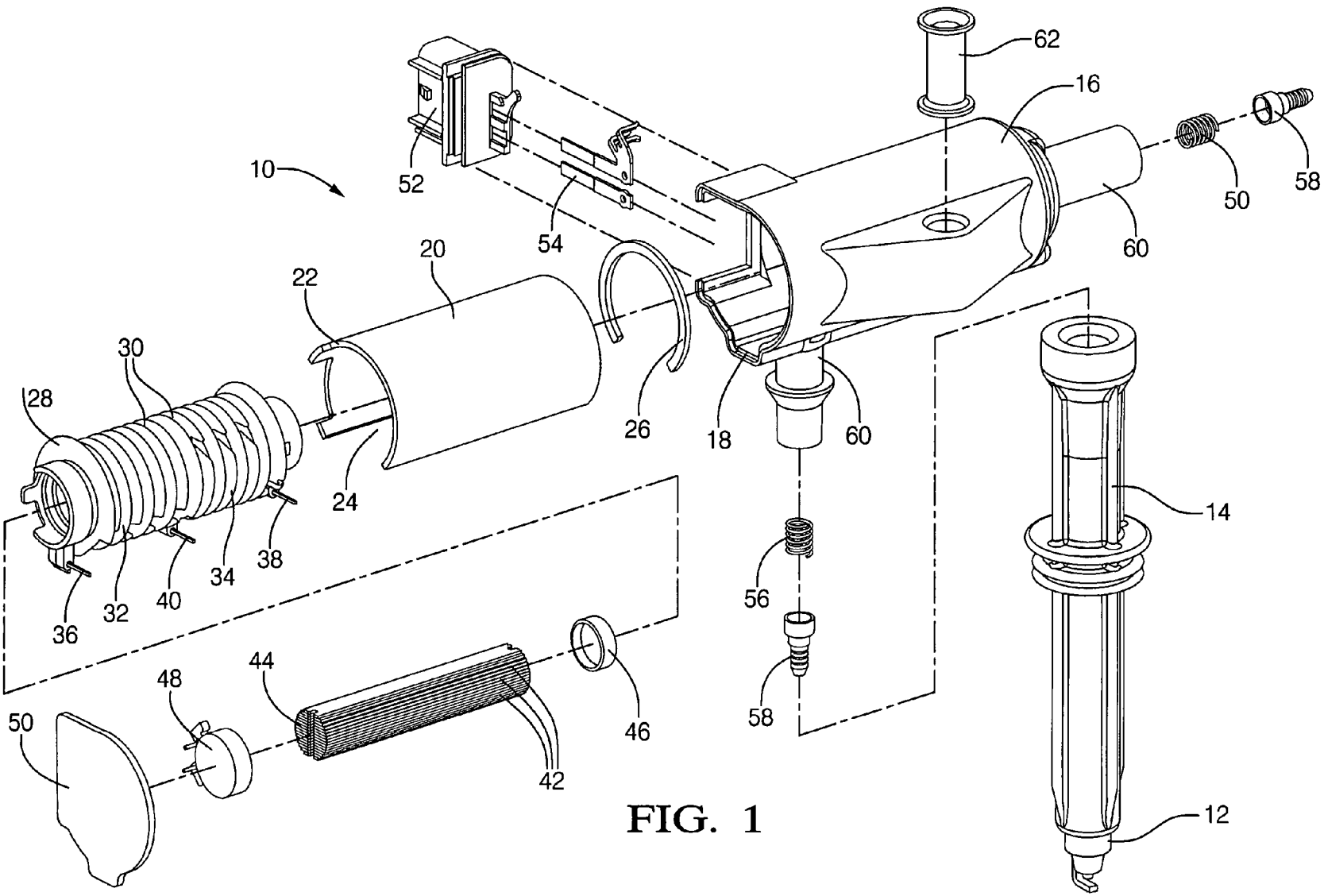
FIG. 1 is a an exploded perspective view of the present ignition coil.

Referring initially to FIG. 1, an ignition coil is shown, generally designated 10, for use in energizing at least one spark plug (only a single spark 12 shown) that is disposed in a high voltage spark plug boot 14 and that extends into an engine cylinder in accordance with principles known in the art. The ignition coil 10 is but one of plural coils that would be used in an engine having more than two cylinders in a distributorless ignition system, i.e., no distributor exists between the ignition coil 10 and its spark plugs 12.

Figures 2, 4, 5:
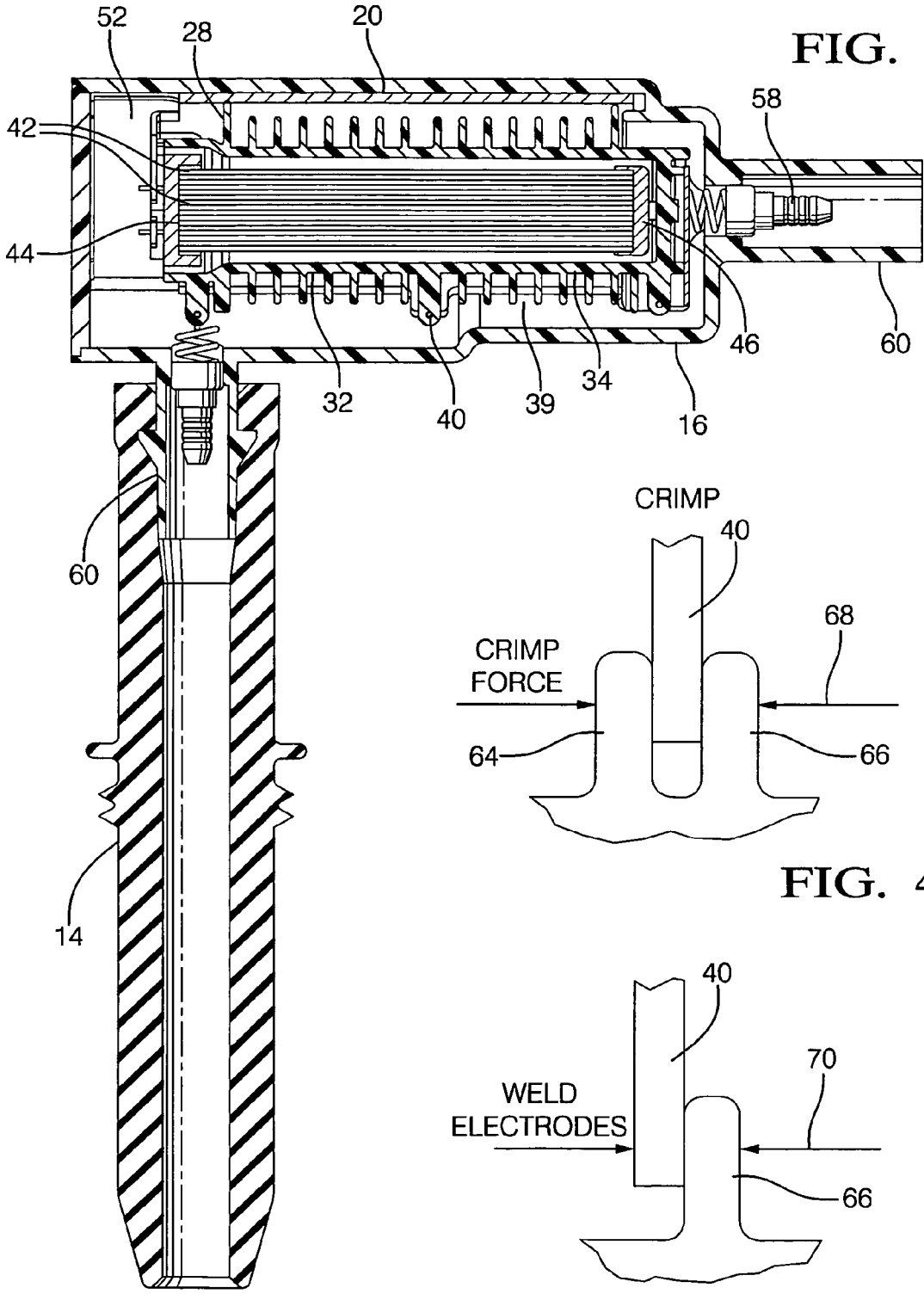
FIG. 2 is a cut-away side elevational view of the present ignition coil.
FIG. 4 is a schematic view showing one way for establishing the center tap connection to the shield.
FIG. 5 is a schematic view showing another way for establishing the center tap connection to the shield.

Cross-referencing FIGS. 1 and 2, the ignition coil 10 includes a case 16 that defines a closable open end 18. An electrically conductive magnetic shield 20 made of, e.g., silicon steel, is disposed within the case 16 substantially coaxially with the case 16 to magnetically isolate the below-described windings from exterior components. As shown, an end 22 of the shield 20 is juxtaposed with the closable open end 18 of the case 16. In the embodiment shown the shield 20 defines a substantial portion of a cylinder, i.e., the shield 20 may define, for instance, an axial slit 24 in an otherwise cylindrical surface to limit eddy current losses in the shield. If desired, a rubber-like shield buffer ring 26 may be disposed between the shield 20 and case 16 to accommodate thermal expansion and contraction of the metal parts.

As shown in FIGS. 1 and 2, the shield 20 closely surrounds a secondary winding spool 28 that is generally cylindrical and that has axially-spaced ribs 30 that together define a segmented winding path. First and second electrically conductive wire secondary windings 32, 34 are disposed in the winding path defined by the spool 28 and are in axial sequence to each other. A spark plug end of the first secondary winding 32 is connected to a first terminal 36, while a spark plug end of the second secondary winding 34 is connected to a second terminal 38. The ends of the secondary windings 32, 34 that are opposite to the spark plug ends are each connected to a center tap terminal 40, which may be established by one or more electrical conductors, e.g., by a wire having a square cross-section. The secondary windings 32, 34 may be wound oppositely to each other relative to the axial dimension of the coil 10. A dielectric material 39 (FIG. 2) such as epoxy may be disposed between the secondary winding spool 28 and the case 16.

In accordance with ignition coil principles known in the art, a primary wire winding 42 is wound around a soft iron core 44 that is coaxially disposed within the secondary winding spool 28. The core 44, which may be made of silicon steel laminations or compression molded iron particles or other appropriate material, is bounded at its ends by a silicon or rubber buffer cup 46 and a primary cap 48. The open end of the case 16 is closed by a cover 50.

It is to be understood that the primary winding 42 is electrically connected, via a connector member 52 with two or more terminals 54, to an ignition system that selectively energizes the primary winding 42 from a source of voltage such as a vehicle battery in accordance with ignition coil principles known in the art. As shown best in FIG. 2, the connector member 52 is disposed in the case 16 adjacent the open end 18 of the case 16 and, hence, adjacent the end 22 of the shield 20.

When the primary winding 42 is energized, the cooperation between the core 44, primary winding 42, and secondary windings 32, 34 results in inductive coupling between the primary winding 42 and secondary windings 32, 34. Owing to this coupling and to the different number of turns between primary and secondary, the relatively low battery voltage in the primary winding 42 is transformed into relatively higher voltages in the secondary windings 32, 34 for provision of the higher voltages to the spark plugs.

Thus, the terminals 36, 38 of the secondary windings 32, 34 are connected to respective spark plugs using connector structure known in the art, e.g., each terminal 36, 38 may be electrically connected to a respective spring 56 with associated terminal cup 58. A so-called tower 60 may be formed as part of the case 16, and a mount support bushing 62 (FIG. 1) may be provided to mount the case 16 onto a vehicle.

Figure 3:
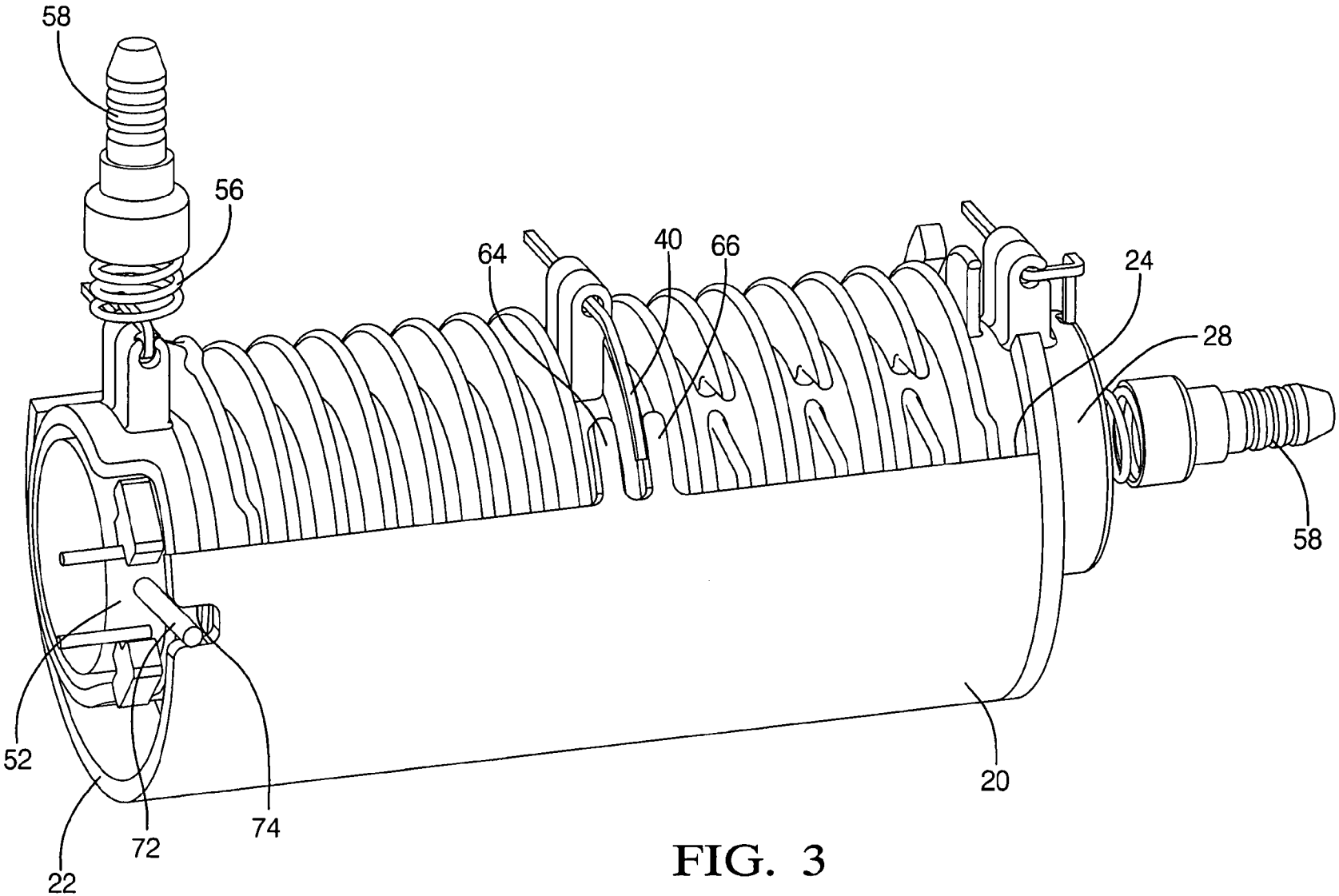
FIG. 3 is a perspective view of the ignition coil with the case removed to show the center tap connection to the shield.

In accordance with the present invention and now referring to FIG. 3, the shield 20 that surrounds the secondary windings 32, 34 is electrically connected to the center tap terminal 40 between the secondary windings 32, 34. In one illustrative embodiment, the shield 20 may be integrally formed with first and second tabs 64, 66 that extend into the axial slit 24 and that form a space between them for receiving the center tap terminal 40. As shown in cross-reference to FIGS. 3 and 4, a crimp force, represented by arrows 68, can be applied to the tabs 64, 66 to crimp the terminal 40 between the tabs. Or, only a single tab 66 need be provided, in which case weld electrodes represented by arrows 70 in FIG. 5 can be used to pinch weld the terminal 40 to the tab 66. It is to be understood that the structure shown in FIGS. 3-5 for connecting the center tap of the secondary windings 32, 34 to the shield 20 are exemplary and non-limiting.

Recall that the center tap terminal 40 is electrically connected to each secondary winding 32, 34. Thus, the secondary windings 32, 34 are electrically connected to the shield 20. Further, as best shown in FIG. 3, the end 22 of the shield 20 that is juxtaposed with connector member 52 can be electrically coupled to the connector member 52. For example, a slot 72 may be formed in the end 22 of the shield 20, and a connector element 74 of the connector member 52 engaged with the slot. With this structure, the shield 20 (and, hence, secondary windings 32, 34) may be connected, via the connector member 52, to ground (for three-conductor systems) or to battery positive (for two-conductor systems) at or substantially near the end 22 of the shield 20, thereby simplifying wiring within the ignition coil 10.

It may now be appreciated that the shield 20 establishes a portion of an electrical circuit including the first secondary winding 32 and a first spark plug, and that the shield 20 further establishes a portion of an electrical circuit including the second secondary winding 34 and a second spark plug. That is, the shield 20 completes the electrical circuit for each secondary winding 32, 34.

While the particular IGNITION COIL WITH SECONDARY WINDING CENTER TAP CONNECTED TO SHIELD as herein shown and described in detail is fully capable of attaining the above-described objects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it is to be encompassed by the present claims. Furthermore, no element, component, or method step in the present disclosure is intended to be dedicated to the public regardless of whether the element, component, or method step is explicitly recited in the claims.

No claim element herein is to be construed under the provisions of 35 U.S.C. section 112, sixth paragraph, unless the element is expressly recited using the phrase "means for."

We claim:

1. A distributorless ignition coil for use in an automotive type electrical system having a battery voltage and electrical ground, comprising:

a single primary winding;

at least first and second secondary windings in axial sequence to each other and surrounding the primary winding, each secondary winding being electrically connectable to a respective spark plug, each secondary winding being inductively couplable to the primary winding and configured to transform relatively lower voltage from the primary winding to relatively higher voltage for supply thereof to the spark plugs;

a center tap terminal located between the first and second secondary windings, an end of each secondary winding proximal the center tap terminal being electrically connected to the center tap terminal; and a shield surrounding the secondary windings and electrically connected to the center tap terminal, the shield also configured to be electrically connected to one of: electrical ground, or battery voltage, when in use in an automotive type electrical system having a battery voltage and electrical ground.

2. The ignition coil of claim 1, wherein the shield defines an end, and the shield is configured to be connected to electrical ground or battery voltage at or substantially near the end.

3. The ignition coil of claim 2, comprising a case holding the shield and windings and defining a closable open end, the end of the shield being juxtaposed with the closable open end of the case.

4. The ignition coil of claim 1, wherein the shield is formed with two tabs defining a space between them for receiving the center tap terminal, the tabs being crimped to hold the center tap terminal therebetween.

5. The ignition coil of claim 1, wherein the shield is formed with one and only one tab, the center tap terminal being welded to the tab.

6. The ignition coil of claim 1, wherein the secondary windings are wound oppositely to each other relative to an axial dimension of the coil.

7. An ignition coil, comprising:

a single primary winding receiving voltage from a source of voltage in a vehicle;

at least first and second secondary windings inductively coupled to the primary winding; and at least one shield surrounding the secondary windings and radially spaced therefrom, the shield defining a substantial portion of a cylinder, the shield establishing a portion of an electrical circuit including the first secondary winding and a first spark plug, the shield further establishing a portion of an electrical circuit including the second secondary winding and a second spark plug.

8. The ignition coil of claim 7, wherein no distributor is in either circuit.

9. The ignition coil of claim 8, wherein the secondary windings are in axial sequence to each other, each secondary winding terminating at a center tap between the secondary windings, the shield being electrically connected to the center tap.

10. The ignition coil of claim 9, wherein the shield defines an end, and the shield is connected to electrical ground or battery voltage at or substantially near the end.

11. The ignition coil of claim 10, comprising a case holding the shield and windings and defining a closable open end, the end of the shield being juxtaposed with the closable open end of the case.

12. The ignition coil of claim 7, wherein the shield is formed with two tabs defining a space between them for receiving a center tap terminal between the secondary windings and electrically connected to each secondary winding, the tabs being crimped to hold the center tap terminal therebetween.

13. The ignition coil of claim 7, wherein the shield is formed with one and only one tab, a center tap terminal being welded to the tab, the center tap terminal being electrically connected to each secondary winding.

14. The ignition coil of claim 7, wherein the secondary windings are wound oppositely to each other relative to an axial dimension of the coil.

15. A distributorless ignition system for a vehicle engine, comprising:

plural ignition coils, each ignition coil having a single primary winding and having first and second secondary windings electrically connected to respective spark plugs, each ignition coil including a shield surrounding the secondary windings and completing an electrical circuit for each secondary winding.

16. The system of claim 15, wherein the shield completes an electrical circuit to ground.

17. The system of claim 15, wherein the shield completes an electrical circuit to a voltage source.

18. The system of claim 15, wherein the secondary windings are inductively coupled to a primary winding receiving voltage from a voltage source in the vehicle, the secondary windings being connected to a common center tap located axially between the secondary windings, the center tap being electrically connected to the shield.

19. The system of claim 18, wherein the shield is formed with two tabs defining a space between them for receiving a center tap terminal, the tabs being crimped to hold the center tap terminal therebetween.

20. The system of claim 18, wherein the shield is formed with one and only one tab, a center tap terminal being welded to the tab.

* * * * *